US006198434B1

(12) United States Patent
Martek et al.

(10) Patent No.: US 6,198,434 B1
(45) Date of Patent: Mar. 6, 2001

(54) DUAL MODE SWITCHED BEAM ANTENNA

(75) Inventors: Gary A. Martek, Edgewood; J. Todd Elson; Leibing Huang, both of Bellevue, all of WA (US)

(73) Assignee: Metawave Communications Corporation, Redmond, WA (US)

( * ) Notice: Subject to any disclaimer, the term of this patent is extended or adjusted under 35 U.S.C. 154(b) by 0 days.

(21) Appl. No.: 09/213,640

(22) Filed: Dec. 17, 1998

(51) Int. Cl.[7] ..... H01Q 3/22; H01Q 3/24; H01Q 3/26

(52) U.S. Cl. ..... 342/373; 343/813; 343/814

(58) Field of Search ..... 342/373; 343/820, 343/813, 814, 816

(56) References Cited

U.S. PATENT DOCUMENTS 4,231,040 * 10/1980 Walker .
4,973,971 * 11/1990 Sinsky et al. ..... 342/373
5,086,302 * 2/1992 Miller ..... 342/373
5,589,843 12/1996 Meredith et al. ..... 343/820
5,774,090 6/1998 Marcy et al. ..... 342/372
5,825,762 * 10/1998 Kamin, Jr. et al. ..... 370/335

OTHER PUBLICATIONS

PCT International Search Report dated Apr. 25, 2000.

* cited by examiner

*Primary Examiner*—Theodore M. Blum
(74) *Attorney, Agent, or Firm*—Fulbright & Jaworski L.L.P.

(57) ABSTRACT

Systems and methods for providing antenna beams having reduced grating and side lobes when steered off of the antenna broadside are disclosed. According to the present invention an arrangement of antenna elements suitable for use in generating antenna beams steered at greater angles off of the antenna broadside is utilized with a beam feed network consistent with the antenna beams being steered at the greater angles and reduced antenna element spacing to provide the reduced grating and side lobes. A preferred embodiment utilizes a $2_{n+1}$ Butler matrix coupled to $2_{n+1}$ antenna columns spaced according to the present invention to provide $2_n$ antenna beams.

53 Claims, 5 Drawing Sheets

--- BEAM 4 x 4, 90° BW, 0 ROTATION
—— BEAM 8 x 4, 90° BW, 0 ROTATION

--- BEAM 4 x 4, 112° BW, 30 ROTATION
—— BEAM 8 x 4, 107° BW, 30 ROTATION

DUAL MODE SWITCHED BEAM ANTENNA

RELATED APPLICATIONS

The present invention is related to and commonly assigned U.S. patent application Ser. No. 09/034,471 entitled "System and Method for Per beam Elevation Scanning," filed Mar. 4, 1998, and commonly assigned U.S. patent application Ser. No. 08/896,036 entitled "Multiple Beam Planar Array With Parasitic Elements," filed Jul. 17, 1997, and commonly assigned U.S. patent application Ser. No. 09/060,921 entitled "System and Method Providing Delays for CDMA Nulling," filed Apr. 15, 1998, the disclosures of which are hereby incorporated herein by reference.

TECHNICAL FIELD

This invention relates to phased array antennas, and, more particularly, to the reduction of grating lobes associated with the use of phased array antennas.

BACKGROUND

It is common to use a single antenna array to provide a radiation pattern, or beam, which is steerable. For example, steerable beams are often produced by a planar or panel array of antenna elements each excited by a signal having a predetermined phase differential so as to produce a composite radiation pattern having a predefined shape and direction. In order to steer this composite beam, the phase differential between the antenna elements is adjusted to affect the composite radiation pattern.

A multiple beam antenna array may be created, utilizing a planar or panel array described above, for example, through the use of predetermined sets of phase differentials, where each set of phase differential defines a beam of the multiple beam antenna. For example, an array adapted to provide multiple selectable antenna beams, each of which is steered a different predetermined amount from the broadside, may be provided using a panel array and matrix type beam forming networks, such as a Butler or hybrid matrix.

When a planar array is excited uniformly (uniform aperture distribution) to produce a broadsided beam projection, the composite aperture distribution resembles a rectangular shape. When this shape is Fourier transformed in space, the resultant pattern is laden with high level side lobes relative to the main lobe. Moreover, as the beam steering increases, i.e., the beam is directed further away from the broadside, these side lobes grow to higher levels. For example, a linear array with its beam-peak at $\Theta_o$ can also have other peak values subject to the choice of element spacing "d". This ambiguity is apparent, since the summation also has a peak whenever the exponent is some multiple of $2\pi$. At frequency "f" and wavelength lambda, this condition is $2\pi(d/\lambda)(\sin\Theta_{scan}-\sin\Theta_O)=2\pi p$ for all integers p. Such peaks are called grating lobes and are shown from the above equation to occur at angles $\Theta p$ such that $\sin\Theta_p=\sin\Theta_O=2\pi p$. Accordingly, when the radiation pattern is steered too far relative to the element spacing a grating lobe will appear which can have a peak in its pattern nearly equal to the main lobe of the radiation pattern. The point at which this occurs is generally considered the maximum useful steering angle of the array.

Even when steering of the main beam is restricted to angles such that the grating lobe presents a peak appreciably less than that of the main lobe, the presence of the grating lobe acts to degrade the performance of the antenna system by making it responsive to signals in an undesired direction, potentially interfering with the desired signal. Specifically, as the main beam is steered off of the broadside of the array, the grating lobe will often be directed at an angle within the range of angles the antenna array is operable within. Accordingly, the presence of a stray communication beam having a substantial peak associated therewith and present within the area of operation of the antenna array will very often be a source of interference. Moreover, as the grating lobe is substantially coaxial with the axis of radiation of the antenna panel, it is generally not possible to avoid this interference with solutions such as tilting the array to point the grating lobe in a harmless direction.

Additionally, broadside excitation of a planar array yields maximum aperture projection. Accordingly, when such an antenna is made to come off the normal axis, i.e., steered away from the broadside position which is normal to the ground surface and centered to the surface itself, the projected aperture area decreases causing a scan loss. This scan loss further aggravates the problems associated with the grating lobes because not only is the aperture area of the steered beam decreased due to the effects of scan loss, but the unwanted grating lobes are simultaneously increased due to the effects of beam steering.

Accordingly, a need exists in the art for a system and method of providing antenna beams having a desired beam widths and azimuthal orientations without suffering from the presence of grating lobes when steered a desired amount off of the broadside.

Moreover, as multiple beam antenna arrays are useful in providing wireless communication networks, such as cellular and/or personal communication services (PCS) networks (referred to hereinafter collectively as cellular networks), which are often simultaneously provided in a same service area, a need exists in the art for the systems and methods adapted to provide desired antenna beams substantially free of grating lobes to also be adapted for dual mode service.

SUMMARY OF THE INVENTION

These and other objects, features and technical advantages are achieved by an antenna array, such as a multiple beam antenna system including a beam forming matrix, wherein only the inner most beams of those possible from the array are utilized and the pertinent antenna element column or row spacing is adjusted to achieve the desired antenna beam shapes, i.e., beam widths, and sector pattern. The radiation pattern resulting from the use of such an antenna, whether relying on restricted beam switching of a multiple beam array or restricted scanning of an adaptive array, utilizing only the inner beams has the desired characteristic of avoiding the grating lobes associated with the outer most antenna beams, or other antenna beams steered substantially from the broad side, of an array.

An antenna array for providing desired communications may use four beams, i.e., a panel having four antenna columns provides four 30° substantially non-overlapping antenna beams which when composited provide a 120° sector. The beam forming matrix for such an array may be a 4×4 Butler matrix, a matrix having inputs and outputs limited to powers of two (inputs/outputs=$2^n$, wherein n=2 for the 4×4 matrix), providing the signals of four antenna beam interfaces in a phased progression at each of the four antenna columns. These beams may be referred to as, from left to right viewing the antenna array from the broadside, 2R, 1R, 1L, 2L, with the beams steered at the most acute angle off of the broadside, beams 2R and 2L, having substantial grating lobes associated therewith.

A preferred embodiment of the present invention utilizes an antenna capable of providing antenna beams steered further off of the broad side than those relied upon for providing communication. For example, a preferred embodiment utilizes a beam forming matrix having $2^{n+1}$ inputs for forming $2^n$ antenna beams. Accordingly, in the above example where four ($2^2$) beams are desired, a beam forming matrix having eight ($2^3$) inputs and outputs is utilized. In order to provide the desired beams without the presence of grating lobes while still providing tolerable side lobe levels, and a desirable main beam, the antenna array fed by the beam forming matrix of this embodiment of the present invention has a number of antenna columns corresponding to the n+1 inputs. Therefore, the eight outputs of the beam forming matrix are each coupled to one of eight antenna columns of an antenna array and is thus capable of providing eight antenna beams (4R, 3R, 2R, 1R, 1L, 2R, 3R, and 4R).

According to the present invention, although the antenna array may be capable of forming a number of beams in excess of those desired, only the inner beams are used. For example, in the preferred embodiment described above only the 2R, 1R, 1L, and 2R beams are used out of an available combination of 4R, 3R, 2R, 1R, 1L, 2L, 3L, and 4L beams. These inner most beams typically have better radiation characteristics than the outer most beams and therefore do not present the grating lobes it is a purpose of the present invention to avoid.

However, it should be appreciated that the characteristics of the individual antenna beams of the above described array of the present invention will not substantially conform to those of the antenna array it is intended to replace. For example, rather than providing four approximately 30° antenna beams which define a 120° sector, the 2R, 1R, 1L, and 2R beams of the 8×8 beam forming matrix used according to the present invention may provide four approximately 15° antenna beams which define a 60° sector because of the increased number of antenna columns energized in the phase progression.

Accordingly, the present invention, includes adjustment of the antenna column and/or row spacing to re-point the used beams in the desired direction although the phase progression utilized for a more narrow beam eight beam array are maintained. Moreover, as the inter column spacing is adjusted to re-point the beams at desired angles from the broadside, so too are the antenna beam widths adjusted to desired widths. Accordingly, the above described preferred embodiment antenna array having an 8×8 beam forming matrix may be utilized to provide four substantially 30° beams defining a 120° sector.

The respacing of antenna elements according to the present invention results in the closing in the elemental spacing which has the desirable effect of reducing or even suppressing any grating lobes that may have been present in the original array. Moreover, elemental spacing according to the present invention may be adjusted to affect the best possible compromise between independent modes, such as advanced mobile phone services (AMPS) and code division multiple access (CDMA) communication signals, that may be using the array simultaneously.

Although described above with respect to an antenna array utilizing a beam forming matrix having a number of inputs associated with multiple antenna beams, an alternative embodiment of the present invention utilizes an adaptive beam forming matrix in combination with the array having additional columns and respaced antenna elements in order to provide a steerable antenna beam which, when steered significantly off broadside, has little or no grating lobe associated therewith. Such an embodiment preferably relies upon a feed network dynamically providing a phase progression across the antenna columns rather than the fixed phase progression of the above mentioned Butler and hybrid beam forming matrixes. Accordingly, it should be appreciated that the phase progression provided by this adaptive feed network is consistent with that of the more narrow beams of the larger array, although utilized to provide a lesser number of improved beams according to the present invention.

A technical advantage of the present invention is to use a phased array antenna to provide multiple or steerable antenna beams with reduced or no grating lobes.

A further technical advantage of the present invention is to provide an antenna which is optimized for use in communicating multiple communication modes simultaneously.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWING

For a more complete understanding of the present invention, and the advantages thereof, reference is now made to the following descriptions taken in conjunction with the accompanying drawing, in which.

DETAILED DESCRIPTION

Figure 1:
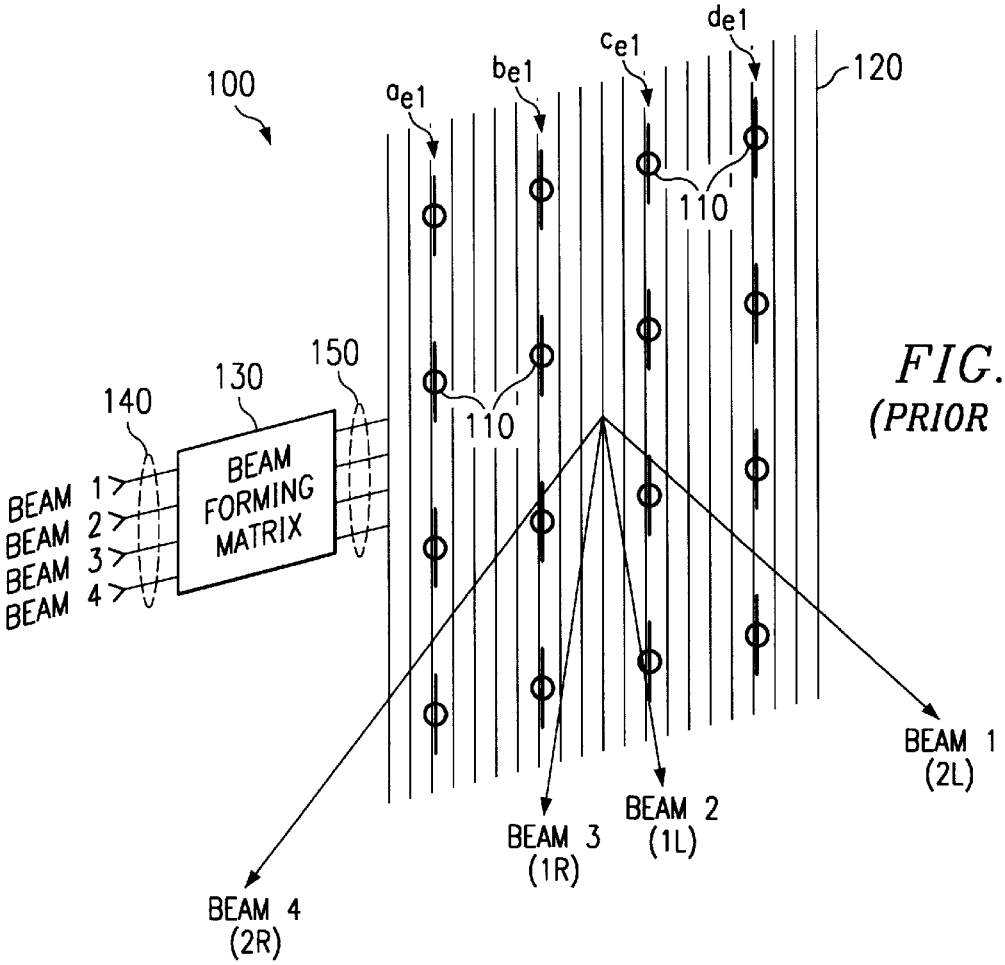
FIG. 1 (PRIOR ART)
FIG. 1 shows a prior art phased array panel antenna adapted to provide four antenna beams.

A typical prior art planar array suitable for producing antenna beams directed in desired azimuthal orientations is illustrated in FIG. 1 as antenna array 100. Antenna array 100 is composed of individual antenna elements 110 arranged in a predetermined pattern to form four columns, columns $a_{e1}$ through $d_{e1}$, of four elements each. These antenna elements are disposed a predetermined fraction of a wavelength (λ) in front of ground plane 120. It shall be appreciated that energy radiated from antenna elements 110 is provided in a predetermined phase progression as among the antenna columns, which combined with energy reflected from ground plane 120, sums to form a radiation pattern having a wave front propagating in a predetermined direction.

As shown in FIG. 1, beam forming matrix 130 may include inputs 140, each associated with a particular antenna beam of a multiple beam array, such that a signal provided to any one of these inputs is provided in a predetermined phase progression at each of outputs 150. This type of fixed beam arrangement is common where beam forming matrix 130 is a feed matrix such as a Butler or hybrid matrix. Beam forming matrixes, such as a Butler matrix, are well known in the art. These matrixes typically provide for various phase delays to be introduced in the signal provided to various columns of the antenna array such that the radiation patterns of each column sum to result in a composite radiation pattern having a primary lobe propagating in a predetermined direction. Of course, rather than a fixed beam arrangement utilizing a Butler or hybrid matrix, a signal input to beam forming matrix 130 may be adaptively provided to outputs 150 in a desired phase progression to adaptively steer an antenna beam.

In the example illustrated in FIG. 1, each of the beams 1 through 4 is formed by beam forming matrix 130 properly applying an input signal to antenna columns $a_{e1}$ through $d_{e1}$. These beams are commonly referred to from right to left as beams 2L, 1L, 1R, and 2R corresponding to beams 1 through 4 of FIG. 1, and may be utilized to provide communications in a particular area. For example, each of the beams of FIG. 1 may be 30° beams to provide communications in a 120° sector.

Figure 2:
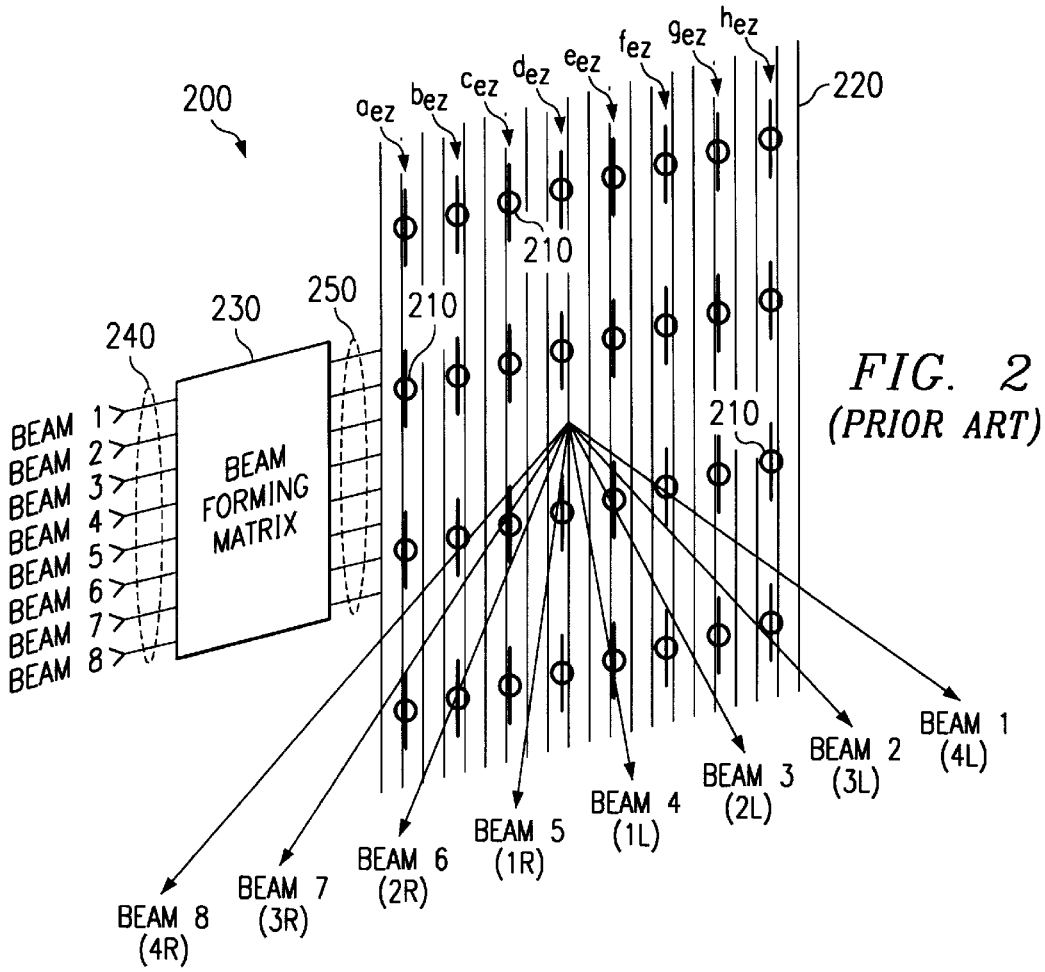
FIG. 2 (PRIOR ART)
FIG. 2 shows a prior art phase array panel antenna adapted to provide eight antenna beams.

Another embodiment of a planar array suitable for producing antenna beams directed in desired azimuthal orientations is illustrated in FIG. 2 as antenna array 200. As with the array of FIG. 1, antenna array 200 is composed of individual antenna elements 210 arranged in a predetermined pattern, although antenna 200 forms eight columns, columns $ae_{e2}$ through $h_{e2}$, of four elements each. These antenna elements are disposed a predetermined fraction of a wavelength (λ) in front of ground plane 220 and energy radiated from antenna elements 210 is provided in a predetermined phase progression as among the antenna columns, which combined with energy reflected from ground plane 220, sums to form a radiation pattern having a wave front propagating in a predetermined direction.

As described above, beam forming matrix 230 may include inputs 240, each associated with a particular antenna beam of a multiple beam array, such that a signal provided to any one of these inputs is provided in a predetermined phase progression at each of outputs 250 or, alternatively, a signal input to beam forming matrix 130 may be adaptively provided to outputs 250 in a desired phase progression to adaptively steer an antenna beam.

Beams 1 through 8 of FIG. 2 are commonly referred to from right to left as beams 4L, 3L, 2L, 1L, 1R, 2R, 3R, and 4R, and may be utilized to provide communications in a particular area. For example, each of the beams of FIG. 2 may be 15° beams to provide communications in a 120° sector.

The composite radiation patterns of the columns of an antenna array such as the beams illustrated in FIGS. 1 and 2 may be azimuthally steered from the broadside through adjusting the a forementioned phase progression. For example, beam 2L (beam 1 of FIG. 1) may be steered 45° from the broadside direction through the introduction of an increasing phase lag (Δ, where Δ<0) between the signals provided to columns $a_{e1}$ through $d_{e1}$. Assuming that the horizontal spacing between each of the columns $a_{e1}$ through $d_{e1}$ is the same, beam 2R may be created by providing column $a_{e1}$ with the input signal in phase, column $b_{e1}$ with the input signal phase retarded Δ, column $c_{e1}$ with the input signal phase retarded 2Δ, and column $d_{e1}$ with the input signal phase retarded 3Δ. Of course the exact value of Δ depends on the spacing between the columns.

Similarly, beam 1L (beam 2 of FIG. 1) may be 15° from the broadside direction through the introduction of a phase lag between the signals provided to the columns. Here, however, the phase differential need not be as great as with beam 2R above as the deflection from broadside is not as great. For example, beam 1R may be created by providing column $a_{e1}$ with the input signal in phase, column $b_{e1}$ with the input signal phase retarded ⅓Δ, column $c_{e1}$ with the input signal phase retarded ⅔Δ(2*⅓ Δ), and column $d_{e1}$ with the input signal phase retarded Δ (3*⅓Δ).

It shall be appreciated that, when a linear planar array is excited uniformly (uniform aperture distribution) to produce a broadsided beam projection, the composite aperture distribution resembles a rectangular shape. However, when this shape is Fourier transformed in space, the resultant pattern is laden with high level side lobes relative to the main lobe. When beam steering is used, i.e., the beam is directed away from the broadside, these side lobes grow to higher levels and ultimately result in grating lobes being formed. For example, beam 2R of FIG. 1 will have associated therewith larger side lobes than those of beam 1R and, therefore, present a radiation pattern typically less desirable than that of beam 1R of FIG. 1.

Figure 3:
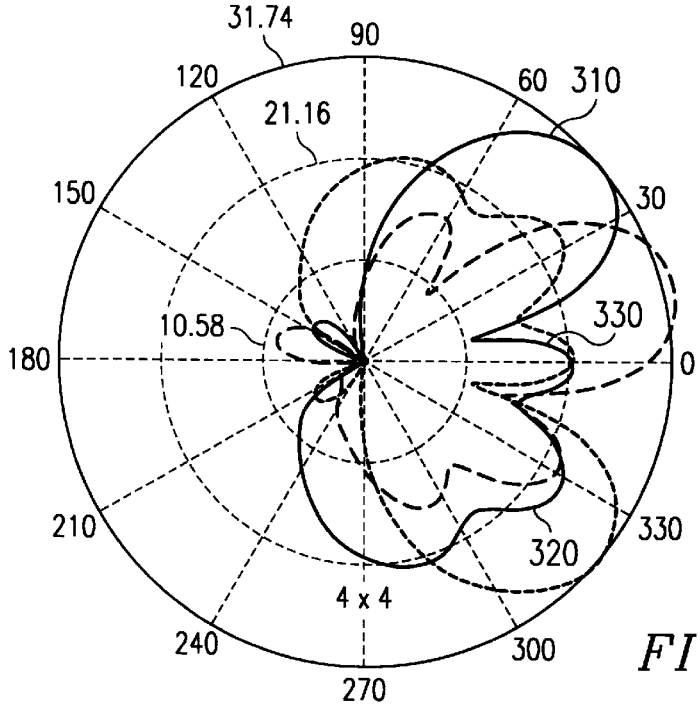
FIG. 3 shows an antenna pattern of the phased array panel antenna of FIG. 1.

Directing attention to FIG. 3, an estimated azimuth far-field radiation pattern using the method of moments with respect to the antenna array shown in FIG. 1 is illustrated. Here the antenna columns are uniformly excited to produce main lobe 310 substantially 45° from the broadside and, thus, substantially as described above with respect to beam 2R.

It shall be understood that, since a beam steered a significant angle away from the broadside, such as beam 2R, presents a less desirable radiation pattern than that of a beam having a lesser angle, such as beam 1R, discussion of the present invention is directed to a beam having a significant angle to more readily illustrate radiation pattern improvement. However, the radiation patterns of beams deflected more or less from the broadside than those described will be similarly improved according to the present invention.

Referring again to FIG. 3, grating lobe 320 and side lobe 330 are illustrated within the 120° sector coverage area of antenna array 100. It can be seen that grating lobe 320 is a substantial lobe peaking only approximately 8 dB less than main lobe 310. The side lobe and grating lobe in particular, act to degrade the performance of the antenna system by making it responsive to signals in an undesired direction, potentially interfering with the desired signal. Specifically, as 0° represents the broadside direction, grating lobe 320 is directed such that communication devices located in front of antenna array 100 may not be excluded from communication when the array is energized to be directed 45° from the broadside.

Moreover, it can be seen from FIG. 3 that, although the 3 dB down points define a beam width of approximately 34°, this beam is somewhat asymmetrical. Specifically, the main lobe exhibits a considerable bulge opposite the aforementioned high level side lobes. This bulge causes the beam not to irregularly taper from the 3dB down points. Therefore, such a beam presents added opportunity for interference by an undesired communication device.

The present invention provides an antenna array which may be utilized to provide antenna beams substantially similar to those of a standard prior art antenna array, including providing coverage within a sector of substantially the same area, with reduced grating and side lobes. According to the present invention, an array having antenna elements sufficient to provide antenna beams in addition to those actually desired, or antenna beams otherwise different than those actually desired, in combination with deploying those antenna elements with a particular inter-element spacing provides improved beam characteristics.

Specifically, a preferred embodiment of the present invention utilizes a beam forming matrix having $2^{n+1}$ inputs for forming $2^n$ antenna beams. Accordingly, to provide four ($2^2$) antenna beams suitable for use in place of those of FIG. 1, an antenna system of this preferred embodiment of the present invention utilizes a beam forming matrix having eight ($2^3$) inputs and outputs, although only four inputs are used, in combination with eight columns of antenna elements spaced according to the present invention.

Figure 4:
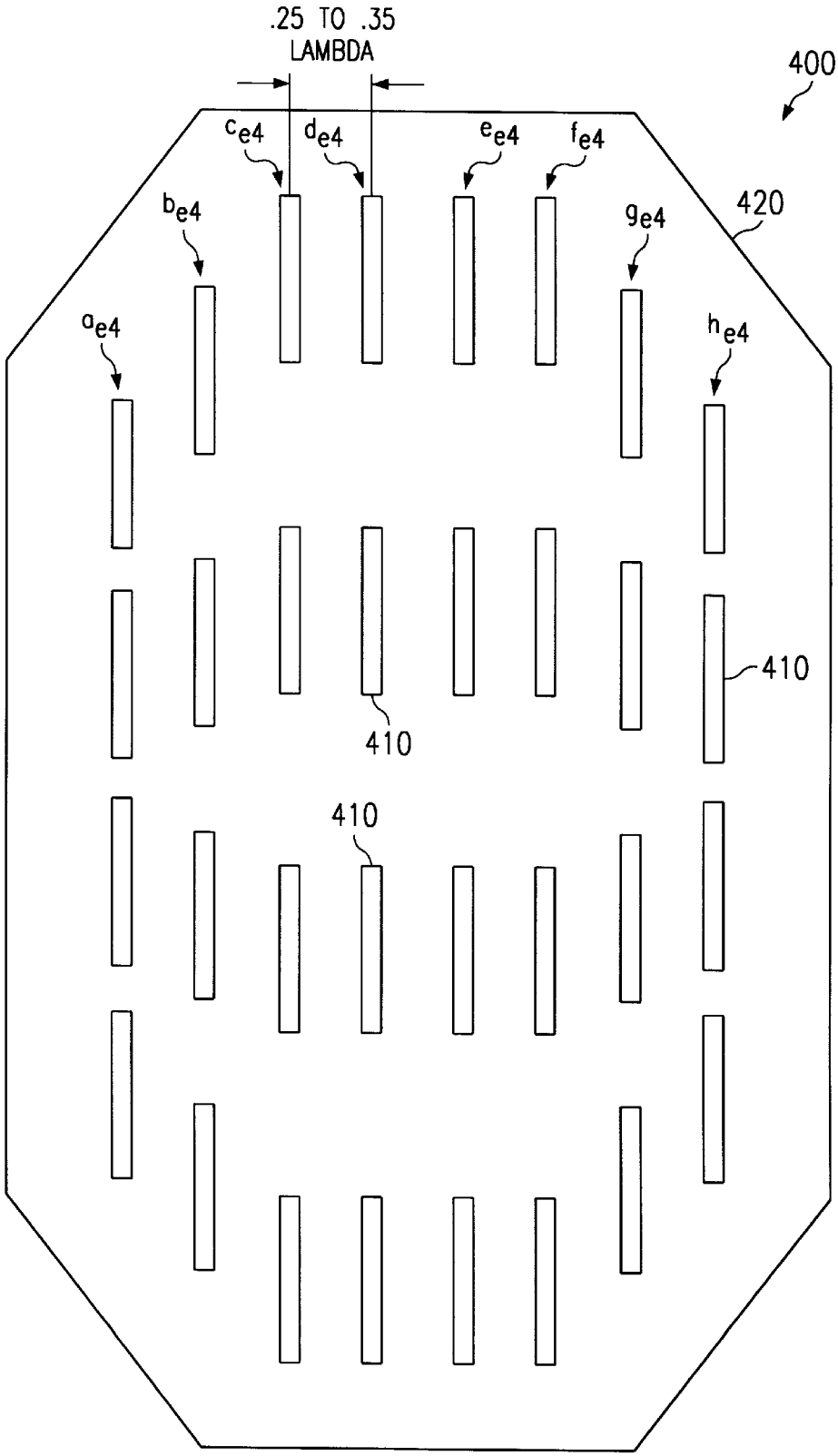
FIGS. 4 and 5 show a phased array panel antenna adapted according to the present invention.

Directing attention to FIG. 4, the above described preferred embodiment antenna adapted according to the present invention to provide four antenna beams having reduced side and grating lobes is shown generally as antenna array 400. It can be seen that like antenna array 200 of FIG. 2, antenna array 400 includes eight radiator columns, columns $a_{e4}$–$h_{e4}$, of four antenna elements 410 each. It shall be appreciated that the preferred embodiment antenna array 400 of FIG. 4 is shown having a number of radiating columns and antenna elements consistent with the above described example of providing four antenna beams in a particular sector according to the present invention in order to aid those of skill in understanding the present invention, and is not intended to limit the present invention to any particular number of radiating columns, antenna elements, or even to the use of a planar panel array.

Preferably the antenna elements utilized in antenna array 400 are dipole antenna elements. However, other antenna elements may be utilized according to the present invention, including helical antenna elements, patch antenna elements, and the like. Moreover, although antenna elements polarized vertically are shown, the present invention may be utilized with any polarization, including horizontal, slant right, slant left, elliptical, and circular. It should also be appreciated that a multiplicity of polarizations may be used according to the present invention, such as by interleaving slant left and slant right antenna columns to provide an antenna system having polarization diversity among the antenna beams provided. These polarization diverse antenna beams may be alternate ones of the substantially non-overlapping antenna beams illustrated in FIG. 4 or, alternatively, may be provided to overlap corresponding beams of an alternative polarization, such as by substantially interleaving two of antenna array 400, each having a different polarization, to provide a polarization diverse antenna array.

In accordance with the principals of the present invention, the antenna columns of antenna array 400 are more closely spaced than those of antenna array 200. For example, rather than a typical inter-column spacing of 0.5λ common in an array such as that of FIG. 2, the array of FIG. 4 utilizes a more narrow inter-column spacing, such as in the preferred embodiment range of 0.25 to 0.35λ, although the same phase progression as that utilized in the 0.5λ element spacing is maintained. A most preferred embodiment of the present invention utilizes an inter-column spacing of 0.27λ where eight antenna columns are coupled to an eight by eight beam forming matrix to provide four substantially 30° antenna beams defining an approximately 120° sector. The use of this more narrow inter-column spacing, in combination with the adaptation of the beam forming network coupled to antenna array 400 to utilize phase progressions generally associated with antenna beams steered at angles from the broadside less than those generally available from an array such as antenna array 200, provides improved grating lobe and side lobe control according to the present invention.

Figure 5:
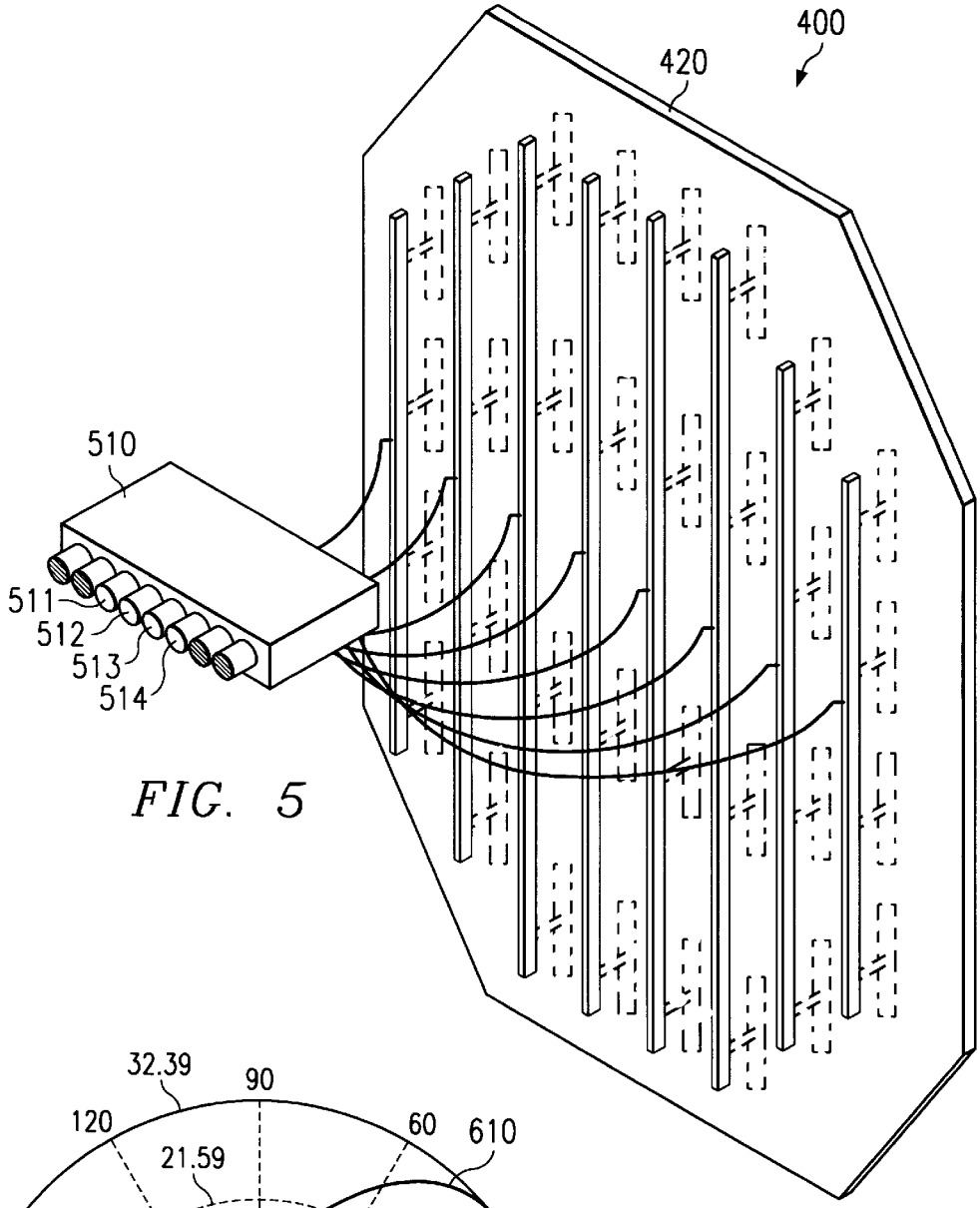

Directing attention to FIG. 5, antenna 400 of FIG. 4 is shown from a reverse angle to reveal the antenna feed network including beam forming matrix 510. Beam forming matrix 510 of the illustrated embodiment is an 8x8 beam forming matrix, such as an 8×8 Butler matrix well known in the art. However, beam forming matrix 510, although providing eight inputs, is adapted to terminate the outer most inputs, i.e., the inputs associated with the outer most antenna beams of an antenna array such as that of FIG. 2, and thus utilizes only the inner most inputs, here the four inner inputs. Accordingly, a signal coupled to each one of inputs 511–514 will be provided as signal components having a particular phase progression at each of the eight outputs of beam forming matrix 510, and thus will be coupled to each of the radiating columns of antenna array 400. Therefore, although the antenna array may be capable of forming a number of beams in excess of those desired, only the inner beams are used. For example, in the preferred embodiment of FIGS. 4 and 5, only the 2R, 1R, 1L, and 2R beams are used out of an available combination of 4R, 3R, 2R, 1R, 1L, 2L, 3L, and 4L beams. These inner most beams typically have better radiation characteristics than the outer most beams and therefore do not present the grating lobes it is a purpose of the present invention to avoid.

It should be appreciated that without the adjusted inter-element placement of the present invention, the use of the inner four inputs of the beam forming matrix would not provide antenna beams consistent with those desired, i.e., antenna beams sized directed substantially the same as those of antenna array 100. For example, rather than providing four approximately 30° antenna beams which define a 120° sector, the 2R, 1R, 1L, and 2R beams of the 8×8 beam forming matrix used according to the present invention may provide four approximately 15° antenna beams which define a 60° sector without the adjusted inter-element placement because of the increased number of antenna columns energized in the phase progression. Accordingly, the present invention, in addition to the use of a beam forming matrix having inputs/outputs, and antenna array having antenna columns, in addition to those associated with the desired antenna beams, includes adjustment of the antenna column and/or row spacing to re-size and re-point the used beams in the desired direction and, thus, the above described preferred embodiment antenna array having an 8×8 beam forming matrix may be utilized to provide four substantially 30° beams defining a 120° sector.

Additional techniques for providing a desired antenna beam may be utilized according to the present invention, if desired. For example, use may be made of parasitic elements, such as shown and described in the above referenced patent application entitled "Multiple Beam Planar Array With Parasitic Elements," in addition to the driven elements shown in FIGS. 4 and 5.

Referring still to the preferred embodiment antenna array of FIGS. 4 and 5, it can be seen that the outer columns of antenna elements, columns $a_{e4}$, $b_{e4}$, $g_{e4}$, and $h_{e4}$, are compressed vertically. By placing reduced in length antenna columns on the outer edges of a phased array, aperture tapering for side lobe level control is further accomplished according to the present invention. Preferably, reduction of the length of the outer antenna columns provides an edge antenna column which is substantially the same length as an antenna column of the array which is not reduced in length but having had its top most and bottom most element removed, i.e., presenting an antenna broadside substantially the size of an array having the corner elements removed. Additional antenna columns may be reduced in length a portion of the amount the outer antenna columns are reduced in length, such as illustrated by the antenna columns next to the outer antenna columns in FIGS. 4 and 5, to further taper the antenna aperture. Of course an alternative embodiment of the present invention may utilize more or fewer antenna columns of reduced length or even antenna columns of all substantially the same length, where the additional side lobe level control afforded is not desired.

The signal feed lines for the antenna columns illustrated in FIG. 5 may be any of a number of feed mechanisms, including coaxial cable with taps at points corresponding to the individual elements, micro-strip lines, and the like. However, a preferred embodiment of the present invention utilizes air-line busses to feed the antenna columns. Preferably, the air-line bus of each column is coupled to the beam forming matrix at a mid point, such as between the middle two antennas of the illustrated columns as shown in FIG. 5. Such a connection aids in providing even power distribution amongst the antenna elements of the column.

It shall be appreciated that a 180° phase shift is experienced in the excitation of the antenna elements disposed on the air-line above the air-line/feed network tap as compared to the antenna elements disposed on the air-line below the air-line/feed network tap. Accordingly, ones of the antenna elements, such as the upper two antenna elements of each column, may be provided with a balun coupled to upper dipole half whereas other ones of the antenna elements, such as the lower two antenna elements of each column, may be provided with a balun coupled to lower dipole half.

It shall be appreciated that in an air-line bus most of the energy is confined in the space between the air-line bus and the ground plane. Accordingly, by placing a dielectric in this space the transmission properties of the antenna column may be substantially altered. Experimentation has revealed that by placing a dielectric between the air-line bus and the ground plane of the antenna array the propagation velocity of the electromagnetic energy being distributed along the column is retarded. This retardation of the propagation velocity, and the subsequent compression of the wave length, allows the spacing of the dipoles to be reduced. This reduction in inter-element spacing is done without adversely affecting the grating lobes. Accordingly, the preferred embodiment utilizes a dielectric between the air-line bus and the ground plane of the antenna array adapted according to the present invention. It shall be appreciated that by utilizing the dielectric line bus of the preferred embodiment, it is possible to taper the aperture of the array without adjusting the number of antenna elements provided in any of the antenna columns. Accordingly, balancing power among the antenna columns of the array is greatly simplified as providing a signal of equal power to each antenna column does not result in energization of the columns in an aperture distribution approaching an inverse cosine distribution as in the prior art. Although described herein with sufficient detail to allow one of skill in the art to understand the present invention, further detail with respect to the use of such air-line bus feed systems is provided in the above reference patent application entitled "System and Method for Per beam Elevation Scanning."

Figure 6:
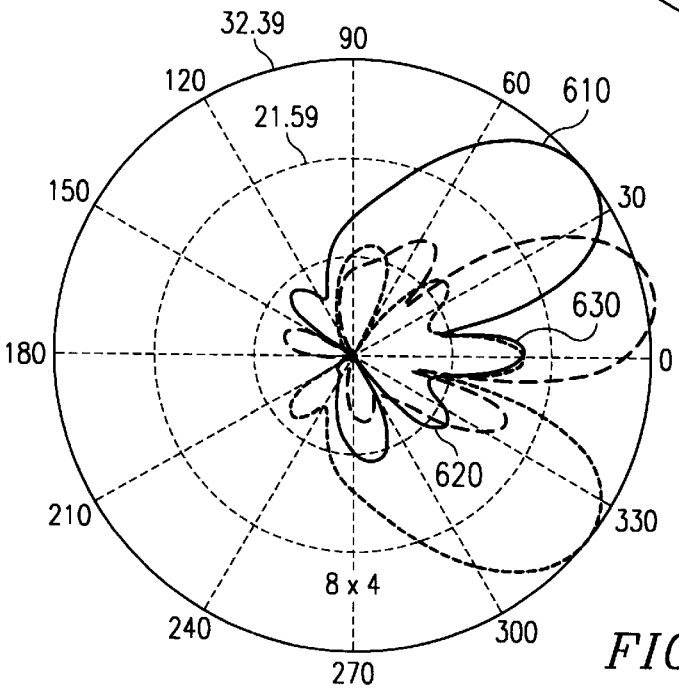
FIG. 6 shows an antenna pattern of the phased array panel antenna of FIGS. 4 and 5.

Having described the preferred embodiment antenna array 400 adapted according to the present invention, attention is directed to FIG. 6, wherein an estimated azimuth farfield radiation pattern using the method of moments with respect to the antenna array shown in FIGS. 4 and 5 is illustrated. Here the antenna columns are uniformly excited, such as through application of a signal to input 511 of beam forming matrix 510, to produce main lobe 610 substantially 45° from the broadside and, thus, substantially as described above with respect to beam 2R associated with the antenna array of FIG. 1. However, it should be appreciated that the grating lobe present in FIG. 3 has been avoided and instead much smaller side lobes 620 and 630 are present. Accordingly, main lobe 610 may be utilized to conduct communications substantially to the exclusion of signals or interference present in other areas to the front of antenna array 400. Moreover, it should be appreciated that main lobe 601 is substantially symmetric and thus provides a beam more suited to providing communications within a defined subsection of an area to be served.

It should be understood that applying a signal to any one of inputs 511–514 of beam forming matrix 510 will provide an antenna beam substantially as illustrated in FIG. 6, although the azimuthal angle of each such beam will be different. Accordingly, a switched beam system, useful in communications wherein reuse of particular channels is desired, having multiple predefined antenna beams each having a particular azimuthal orientation is defined. Such a system is useful for providing wireless communication services such as the cellular telephone communications of an AMPS network, as channel reuse may be increased through limiting communications on a particular channel to within antenna beams which are unlikely to result in interfering signals.

However, the communication requirements of other modes of communication may be somewhat different than that of a particular network, such as the aforementioned AMPS network. For example, CDMA communication networks utilize a same broadband channel for multiple discrete communications, relying upon unique chip codes to separate the signals. Accordingly, although capacity is interference limited, i.e., a particular threshold of communicated energy is established over which it becomes very difficult to extract a particular signal and therefore signals are communicated in defined areas, a larger area than that defined by individual beams may be desired for use in communications, such as to avoid system overhead functions such as handoff conditions. Therefore, it may be desirable to provide a first mode (i.e., AMPS) signal in a particular antenna beam while providing a second mode (i.e., CDMA) signal in multiple beams, such as four beams defining a sector.

The inter-element spacing of the preferred embodiment of the present invention is optimized not only to provide desired control over grating and side lobes, but also to provide a desirable radiation pattern when the array is simultaneously excited at multiple or all beam inputs. Where dual mode signals including AMPS and CDMA signals are to be utilized simultaneously from a single antenna array of the present invention, a preferred embodiment utilizes inter-column spacing of $0.27\lambda$ in order to optimize the radiation pattern resulting from both single beam excitation (associated with a first communication mode) and multiple beam excitation (associated with a second communication mode).

Figure 7:
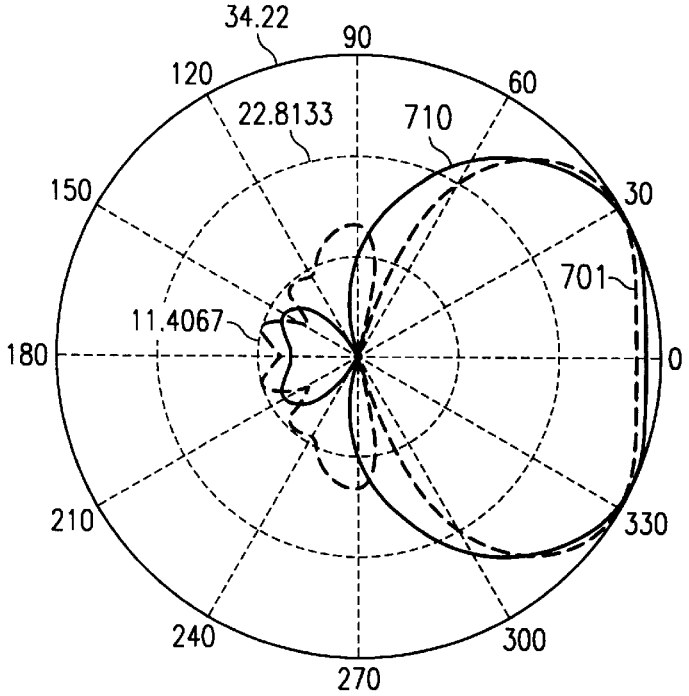
FIGS. 7 and 8 show synthesized sector antenna patterns of the phased array panel antennas of FIG. 1 and FIG. 4.
Figure 8:
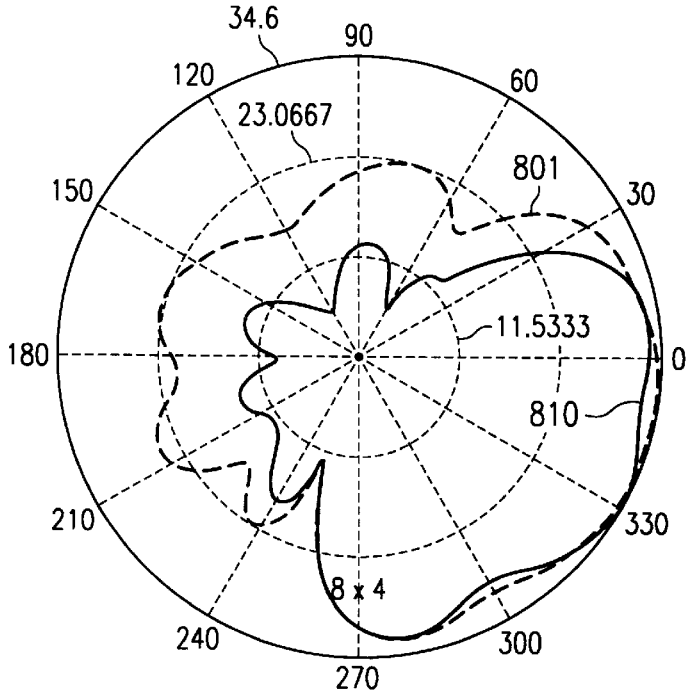

Directing attention to FIGS. 7 and 8, radiation patterns associated with sector signals radiated utilizing antenna arrays substantially as illustrated in FIGS. 1 and 4 are shown. Specifically, radiation pattern 701 results from providing a sector signal in a weighted distribution at multiple ones of the inputs of antenna array 100 and radiation pattern 710 results from providing a sector signal in a weighted distribution at multiple ones of the inputs of antenna array 400. The weighting of the multiple inputs utilized in both of the cases above is the beam forming matrix input associated with beam 2L having the input sector signal −1.5 dB at −78.50°, the beam forming matrix input associated with beam 1L having the input sector signal 0.0 dB at +78.75°, the beam forming matrix input associated with beam 1R having the input sector signal 0.0 dB at +78.75°, and the beam forming matrix input associated with beam 2R having the input sector signal −1.5 dB at −78.50°.

The radiation patterns of FIG. 8 illustrate the use of multiple antenna panels in the generation of a composite antenna beam as is described in detail in the above referenced patent application entitled "System and Method Providing Delays for CDMA Nulling." Accordingly, the composite radiation patterns of FIG. 8 are formed from a sector signal provided in a weighted distribution at multiple ones of the inputs of a first antenna array and an input of a second antenna array which is disposed to provide substantially non-overlapping contiguous coverage with that of the first antenna array. Specifically, radiation pattern 801 results from providing a sector signal in a weighted distribution at multiple ones of the inputs of a first antenna array 100 and a single one of the inputs of a second antenna array 100 and radiation pattern 810 results from providing a sector signal in a weighted distribution at multiple ones of the inputs of a first antenna array 400 and a single one of the inputs of a second antenna array 400. The weighting of the multiple inputs utilized in both of the cases above is with respect to the first antenna panel the beam forming matrix input associated with beam 1L having the input sector signal −0.5 dB at +78.50°, the beam forming matrix input associated with beam 1R having the input sector signal −0.5 dB at +78.75°, and the beam forming matrix input associated with beam 2R having the input sector signal 0.0 dB at −78.50°, and with respect to the second antenna panel the beam forming matrix input associated with beam 2L having the input sector signal 0.0 dB at −78.50° (although any phase relationship may be utilized for the inputs of the second panel when provided with delays as between the first and second panel as shown in the above referenced patent application entitled "System and Method Providing Delays for CDMA Nulling").

Although the specific example shown utilizes only a single input of the second antenna panel, it should be appreciated that there is no such limitation. For example, 2 inputs of a first panel and 2 inputs of a second panel may be utilized in providing a composite radiation pattern synthesizing a desired sector utilizing antennas adapted according to the present invention, if desired. Moreover, there is no limitation to the number of such antennas utilized. For example, a very large antenna composite antenna pattern, i.e., a 360° sector, may be formed utilizing antennas of the present invention by providing the sector signal with proper weighting to inputs of 3 antenna arrays each adapted to provide radiation patterns in a 120° arc.

It can be seen by comparing the radiation patterns of FIGS. 7 and 8 that the back scatter associated with the sector pattern of antenna array 400 is greatly improved over that of antenna array 100. Accordingly, there is less area in which interfering signals or other noise will be received in the synthesized sector beam of the antenna of the present invention. As such antennas of the present invention are uniquely advantageous in allowing sectors of desired sizes to be synthesized and, therefore, selectable as necessary, such as to improve trunking. Moreover, it should be appreciated that the above sector synthesis is provided simultaneously with the ability to provide signals within discrete narrow antenna beams formed by the antenna of the present invention. Accordingly, the present invention simultaneously provides very desirable features for multiple communication modes.

It shall be appreciated that, although primarily described above with reference to transmitting, i.e., a forward link signal, and the use of "inputs" and "outputs" of beam forming matrixes, the present invention is suitable for use in both the forward and reverse links. Accordingly, the antenna beams described above may define an area of reception rather than radiation and, thus, the interfaces of the beam forming matrixes described above as inputs and outputs may be reversed to be outputs and inputs respectively.

Although the present invention and its advantages have been described in detail, it should be understood that various changes, substitutions and alterations can be made herein without departing from the spirit and scope of the invention as defined by the appended claims.

What is claimed is:

1. A method of providing reduced grating lobe levels when at least a first antenna beam is steered off of an antenna broadside at a maximum desired first angle, said method comprising the steps of:

selecting desired operating attributes of said first antenna beam including selecting said first angle and a beam width of said first antenna beam;

identifying an antenna system design having a beam forming circuit and a number of antenna columns coupled thereto suitable for providing an antenna beam steered off of said antenna broadside at a second angle which is greater than said first angle; and deploying said number of antenna columns with an inter-column spacing less than that of said antenna system design while maintaining said beam forming circuit substantially unchanged, wherein said inter-column spacing is selected at least in part to provide an antenna beam substantially meeting said operating attributes.

2. The method of claim 1, wherein said first antenna beam is associated with a first communication mode, and wherein said inter-column spacing is selected at least in part to provide a second antenna beam having desirable characteristics including a wider beam width than said first antenna beam, wherein said second antenna beam is associated with a second communication mode.

3. The method of claim 2, wherein said first communication mode is an analogue cellular format, and said second communication mode is a digital cellular format.

4. The method of claim 1, wherein said first angle is substantially 45° and said beam width is substantially 30°.

5. The method of claim 4, wherein said antenna system design is an eight column planar array having an eight by eight beam forming matrix coupled thereto for forming eight substantially non-overlapping antenna beams.

6. The method of claim 5, wherein said inter-column spacing is within the range of from approximately 0.25λ to approximately 0.35λ.

7. The method of claim 5, wherein said inter-column spacing is 0.27λ.

8. The method of claim 1, wherein said beam forming circuit is an adaptive beam forming circuit providing adjustable steering of said first antenna beam between said first angle and an angle off of said antenna broadside less than said first angle.

9. The method of claim 1, further comprising the step of:

deploying antenna elements in ones of said columns to provide outer columns of said plurality of columns having a reduced length as compared to inner columns of said plurality of columns.

10. The method of claim 9, wherein said step of deploying antenna elements comprises the step of:

introducing a dielectric material into an air-line bus of said outer columns.

11. The method of claim 1, further comprising the step of:

deploying antenna elements in ones of said columns to provide polarization diversity as among said columns.

12. The method of claim 1, wherein said substantially unchanged beam forming circuit is a beam forming matrix having a plurality of antenna beam interfaces a first one of which is coupled to said first antenna beam and a second one of which is associated with said antenna beam steered off of said antenna broadside at said second angle, wherein said second interface is unused as deployed.

13. An antenna system adapted to provide reduced grating lobe levels when at least a first antenna beam is steered off of an antenna broadside at a maximum desired first angle, said system comprising:

beam forming circuitry having at least one A interface associated with said first antenna beam and a plurality of B interfaces having a plurality of phase progressions associated therewith, wherein a first phase progression of said plurality of phase progressions is associated with said first angle; and a plurality of driven antenna elements each coupled to one of said B interfaces, wherein said plurality of phase progressions are consistent with forming antenna beams more narrow than said first antenna beam and at least one antenna beam steered off of the antenna broadside at a second angle which is greater than said first angle, and wherein each of the plurality of driven antenna elements which are coupled to different ones of said B interfaces are spaced a distance from a next adjacent one of the plurality of driven antenna elements which are coupled to different ones of said B interfaces determined to provide said first antenna beam with a desired beam width using said first phase progression.

14. The system of claim 13, wherein said beam forming circuitry comprises:

a beam forming matrix having a plurality of A interfaces of which said at least one A interface is one, wherein a number of said plurality of A interfaces and said plurality of B interfaces is the same.

15. The system of claim 14, wherein at least a second interface of said plurality of A interfaces is associated with a second antenna beam steered off of the antenna broadside at said second angle.

16. The system of claim 15, wherein said second interface is not utilized in forming antenna beams by said antenna system.

17. The system of claim 14, wherein said beam forming matrix is a Butler matrix.

18. The system of claim 15, wherein said number of A interfaces and said number of B interfaces is eight, and wherein four A interfaces are not utilized by an antenna beam of said antenna system.

19. The system of claim 13, wherein said beam forming circuitry comprises:

an adaptive beam forming circuit providing adjustable steering of said first antenna beam.

20. The system of claim 13, wherein said plurality of driven antenna elements comprise:

a plurality of columns of antenna elements each including a same number of individual antenna elements, each column of said plurality being coupled to a different one of said B interfaces, wherein columns disposed at an edge of said antenna system are compressed in size as compared to columns disposed more near the middle of said antenna system.

21. The system of claim 20, wherein said antenna columns are coupled to said B interfaces through a air-line bus, and wherein said columns disposed at said edge of said antenna system include a dielectric disposed in said air-line bus.

22. The system of claim 20, wherein said distance said next adjacent driven antenna elements are spaced is selected from the range of from approximately $0.25\lambda$ to approximately $0.35\lambda$.

23. The system of claim 22, wherein said plurality of columns is eight columns and said first angle is approximately 45°.

24. The system of claim 13, wherein said distance said next adjacent driven antenna elements are spaced is selected at least in part to allow said first antenna beam to be steered said first angle and to have a desired beam width.

25. The system of claim 24, wherein said distance said next adjacent driven antenna elements are spaced is also selected at least in part to allow an antenna beam to be formed having desired characteristics which provides a beam width greater than said first antenna beam.

26. The system of claim 25, wherein said antenna beam larger than said first antenna beam is a synthesized sector.

27. The system of claim 25, further comprising:

a first communication mode associated with said first antenna beam; and a second communication mode associated with said antenna beam larger than said first antenna beam.

28. The system of claim 27, wherein said first communication mode is an analogue cellular telephone communication mode and said second communication mode is a digital cellular telephone communication mode.

29. The system of claim 13, wherein said A interface is a signal input into said beam forming circuitry and said plurality of B interfaces are signal outputs from said beam forming circuitry.

30. The system of claim 13, wherein said A interface is a signal output from said beam forming circuitry and said plurality of B interfaces are signal inputs to said beam forming circuitry.

31. A method of providing a multi-beam antenna having desired antenna beam characteristics, said method comprising the steps of:

selecting a number of antenna beams associated with said multi-beam antenna, wherein said number is $2^n$;

selecting desired operating attributes of said antenna beams including selecting a maximum desired scan angle and a beam width;

providing $2^{n+1}$ antenna columns in a predetermined arrangement wherein each antenna column is spaced equidistant from any adjacent antenna columns; and coupling a beam forming matrix having a first set of interfaces associated with antenna beam signals and a second set of interfaces associated with a phase progression of said antenna beam signals to said antenna columns, wherein second set of interfaces are each coupled to a different one of said antenna columns, wherein said column spacing is selected at least in part to provide said antenna beams with said selected operating attributes.

32. The method of claim 31, wherein said beam forming matrix is a $2^{n+1}$ by $2^{n+1}$ Butler matrix.

33. The method of claim 31, further comprising the step of:

compressing ones of said antenna columns longitudinally to be shorter than other ones of said antenna columns.

34. The method of claim 33, wherein each antenna column of said antenna columns includes a same number of antenna elements therein.

35. The method of claim 34, wherein said number of antenna elements is 4 .

36. The method of claim 33, wherein said compressing step comprises the step of:

disposing a dielectric material in the feed path of said compressed ones of said antenna columns.

37. The method of claim 31, wherein said number n is 2 .

38. The method of claim 37, wherein said column spacing is between 0.25λ and 0.35λ inclusive.

39. The method of claim 37, wherein said column spacing is selected at least in part to provide an antenna beam having desirable attributes when multiple ones of said first set of interfaces are provided a same antenna beam signal.

40. The method of claim 39, wherein said same antenna beam signal provided said multiple ones of said first set of interfaces are weighted differently at ones of said multiple ones of said first set of interfaces.

41. The method of claim 39, wherein a first mode of communication signal is provided individual ones of said first set of interfaces and a second mode of communication signal is provided said multiple ones of said first set of interfaces.

42. The method of claim 41, wherein said first mode is an AMPS type communication format and said second mode is a CDMA type communication format.

43. The method of claim 31, further comprising the step of terminating $2^{n+1}-2^n$ interfaces of said first set of interfaces.

44. A multiple beam antenna system having reduced grating lobe levels associated with outer ones of said multiple beams, said system comprising:

$2^n$ antenna beams having desired operating attributes including a maximum desired scan angle and a substantially same desired beam width;

$2^{n+1}$ antenna columns disposed in a predetermined arrangement wherein each antenna column is spaced equidistant from any adjacent antenna columns at a spacing determined to provide said antenna beams with said operating attributes; and a beam forming matrix having a first set of interfaces associated with antenna beam signals and a second set of interfaces associated with a phase progression of said antenna beam signals coupled to said antenna columns, wherein second set of interfaces are each coupled to a different one of said antenna columns.

45. The system of claim 44, wherein said beam forming matrix is a $2^{n+1}$ by $2^{n+1}$ Butler matrix.

46. The system of claim 44, wherein ones of said antenna columns are shorter than other ones of said antenna columns.

47. The system of claim 46, wherein each antenna column of said antenna columns includes a same number of antenna elements therein.

48. The system of claim 46, wherein said shorter antenna columns include a dielectric material disposed in the feed path of said compressed ones of said antenna columns.

49. The system of claim 44, wherein said number n is 2 .

50. The system of claim 49, wherein said column spacing is between 0.25λ and 0.35λ inclusive.

51. The system of claim 49, wherein said column spacing is 0.27λ.

52. The system of claim 49, wherein said column spacing is also determined to provide an antenna beam having desirable attributes when multiple ones of said first set of interfaces are provided a same antenna beam signal.

53. The system of claim 52, wherein a first mode of communication signal is provided individual ones of said first set of interfaces and a second mode of communication signal is provided said multiple ones of said first set of interfaces.

* * * * *